US006738564B1

(12) United States Patent
Tung

(10) Patent No.: US 6,738,564 B1
(45) Date of Patent: May 18, 2004

(54) HEAT GUN WITH AN EXTENDIBLE/ RETRACTABLE SAFE HEATPROOF SLEEVE

(75) Inventor: Teddy Tung, Taipei Hsien (TW)

(73) Assignee: Wattson Enterprise Co., Ltd., Taipei Hsien (TW)

( * ) Notice: Subject to any disclaimer, the term of this patent is extended or adjusted under 35 U.S.C. 154(b) by 24 days.

(21) Appl. No.: 10/463,520

(22) Filed: Jun. 18, 2003

(51) Int. Cl.[7] ..... F24H 3/00
(52) U.S. Cl. ..... 392/385; 239/288.5
(58) Field of Search ..... 392/385, 383–384, 392/380, 379; 34/96–97; 239/390–391, 397, 288, 288.3, 288.5

(56) References Cited

U.S. PATENT DOCUMENTS 3,943,329 A * 3/1976 Hlavac ..... 392/385
4,538,362 A * 9/1985 Andis ..... 34/97
5,060,398 A * 10/1991 Wolens ..... 34/90
5,671,321 A * 9/1997 Bagnuolo ..... 392/385
5,715,847 A * 2/1998 Rolf et al. ..... 132/271
5,841,943 A * 11/1998 Nosenchuck ..... 392/385
5,987,771 A * 11/1999 Curtin ..... 34/97
6,205,674 B1 * 3/2001 Kaizuka ..... 34/96
6,370,326 B2 * 4/2002 Cheng ..... 392/294

FOREIGN PATENT DOCUMENTS

JP 5-199915 * 8/1993 ..... 392/380

* cited by examiner

*Primary Examiner*—John A. Jeffery

(57) ABSTRACT

A heat gun with an extendible/retractable safe heatproof sleeve comprising of: a housing composed of two hollow half-housings abutted and connected with each other, a muzzle of the heat gun has on the front end thereof a portion with a reduced caliber that has two lateral sides provided each with an axial recess which has an engaging portion; and a heatproof sleeve being a hollow housing, the housing has on each of two lateral sides thereof a sheet extending rearwardly, the sheet is provided on the inner side thereof with a protrusion, so that when the heatproof sleeve is slipped over the front end of the heat gun, the two sheets of the heatproof sleeve extend into the two axial recesses on the portion with the reduced caliber, the engaging portions can engage the protrusions, the heatproof sleeve thereby can slide on the portion with the reduced caliber on the front end of the heat gun and will not drop.

4 Claims, 6 Drawing Sheets

HEAT GUN WITH AN EXTENDIBLE/ RETRACTABLE SAFE HEATPROOF SLEEVE

BACKGROUND OF THE INVENTION

1. Field of the Invention

The present invention is related to a heat gun with an extendible/ retractable safe heatproof sleeve, and especially to a heat gun with an extendible/retractable safe heatproof sleeve on the front end of the shank of the heat gun to avoid accidental hurt by scalding and to protect the shank of the heat gun; it suits for an equipment for heating or drying an article.

2. Description of the Prior Art

In the field of the industry, heat guns are widely used, for example, the arts of electronics, plastic, manufacturing etc. all use heat guns to heat or dry during the processes of manufacturing or assembling products.

Referring to FIG. 1, it is depicted therein the appearance of a conventional heat gun; the structural components of the heat gun include an inner pipe 1 mounted therein with an electric-thermal resistance with a high impedance (not shown); when in use, the muzzle of the heat gun is aimed at an article to be heated, heat is blown out by a fan-motor set on the rear interiorly of the heat gun.

A conventional heat gun mostly is flaunted in designing thereof to have a wide range of temperature controlling, or to have a multi-sectional modulation function of air speed. Indeed, the most importance functions of a heat gun surely is as stated above; in this view, in designing heat guns, people just continuously increase the range of temperature, and by virtue that heat guns are frequently used in construction, the temperatures in the inner sides of the muzzles of the heat guns keep high, if an environment of construction is bad or there is undue using, it is frequent that the scalded inner side induces a vocational disaster.

In view of this, the present invention is developed to overcome the flaws in the conventional heat guns.

SUMMARY OF THE INVENTION

The primary object of the present invention is to provide a heat gun with an extendible/retractable safe heatproof sleeve on the front end of the shank of the heat gun to avoid accidental hurt by scalding and to protect the shank of the heat gun.

To achieve the above stated object, the heat gun with an extendible/ retractable safe heatproof sleeve of the present invention comprises of: a housing composed of two hollow half-housings abutted and connected with each other, the housing has on the front end thereof a reduced caliber that has two lateral sides thereof provided each with an axial recess of which the front end is provided at least with an engaging portion; and a heatproof sleeve able to be slipped over the front end having the reduced caliber of the housing, the heatproof sleeve is a hollow housing having on the two lateral sides thereof two sheets extending rearwardly. When the heatproof sleeve is slipped over the front end of the heat gun, the two sheets extend into the two axial recesses on the portion with the reduced caliber, the heatproof sleeve thereby can slide on the portion with the reduced caliber. The two sheets each is provided on the inner side thereof with a protrusion, so that the heatproof sleeve sliding on the portion with the reduced caliber of the front end of the shank of the heat gun will not drop.

The present invention will be apparent after reading the detailed description of the preferred embodiment thereof in reference to the accompanying drawings.

DETAILED DESCRIPTION OF THE PREFERRED EMBODIMENT

Figure 1:
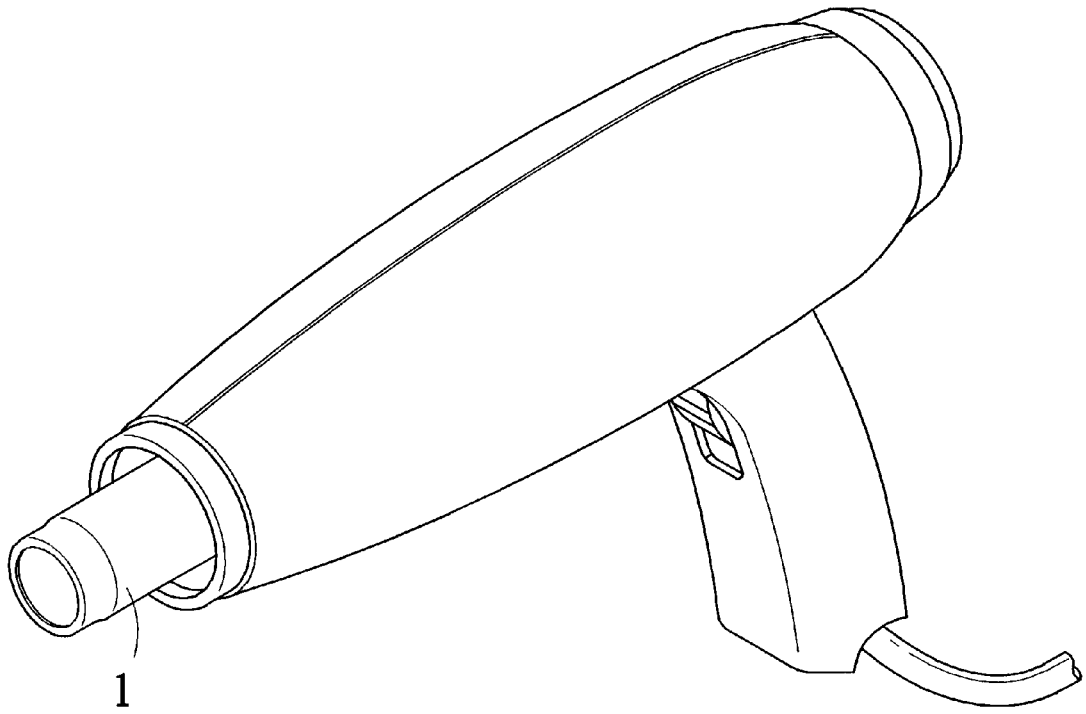
Fig. 1 (Prior Art)
FIG. 1 is a perspective view showing the appearance of a conventional heat-gun.
Figure 2:
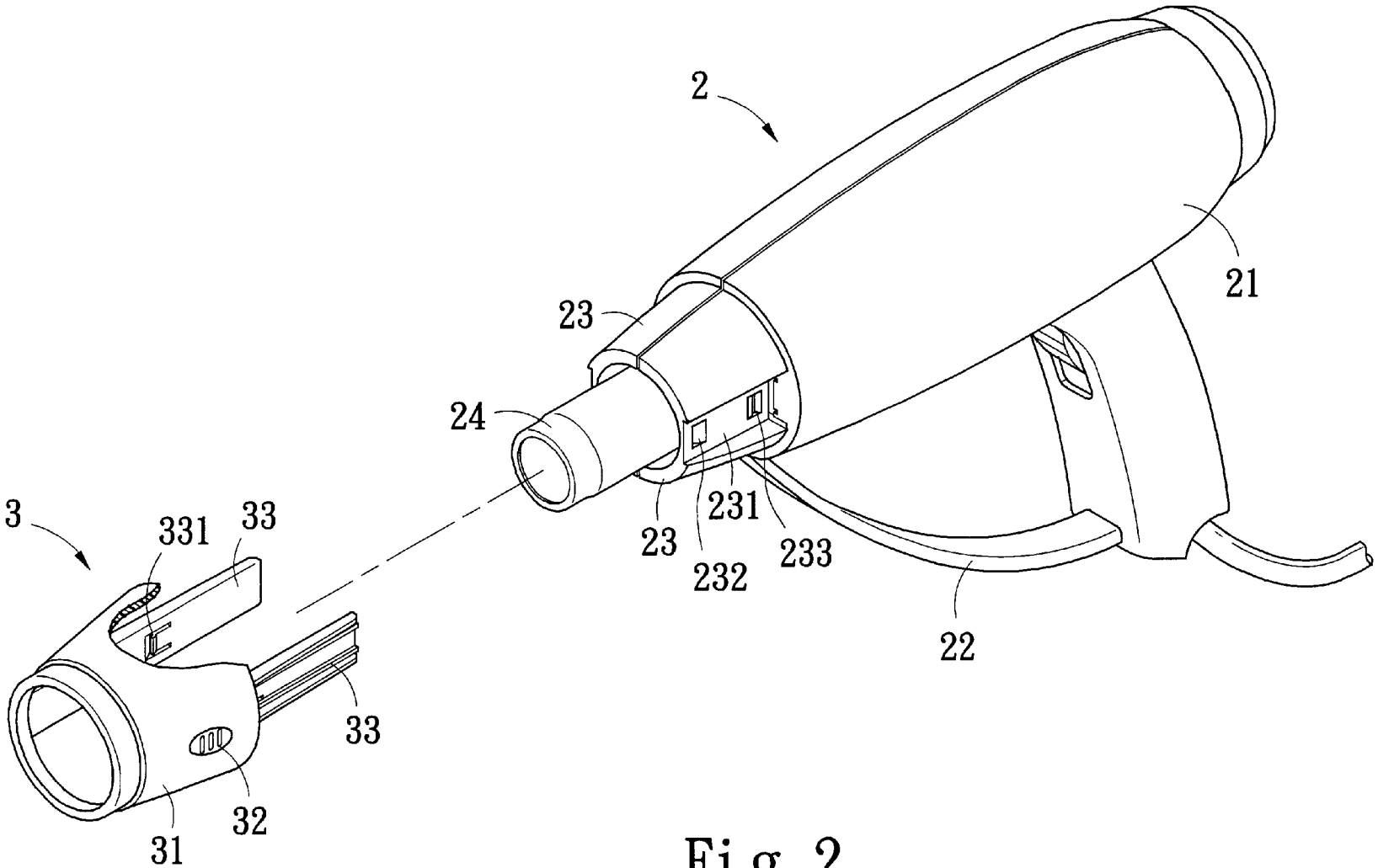
FIG. 2 is a perspective view showing the appearances of a heatproof sleeve and a housing of the present invention.

Referring firstly to FIG. 2 depicting an embodiment of a heat gun of the present invention with an extendible/ retractable safe heatproof sleeve, the heat gun comprises of a housing 2 and a heatproof sleeve 3.

Wherein the housing 2 is composed of two hollow half-housings 21 abutted and connected with each other, a holding portion 22 is connected between the bottom of the shank and the bottom of the handle both of the heat gun have for convenience of holding by a user, the muzzle of the heat gun has on the front end thereof a portion 23 with a reduced caliber that has two lateral sides provided each with an axial recess 231 which is provided with an engaging portion 232; and the housing 2 has therein an inner pipe 24 protruding out of the portion 23 with the reduced caliber.

Figure 3:
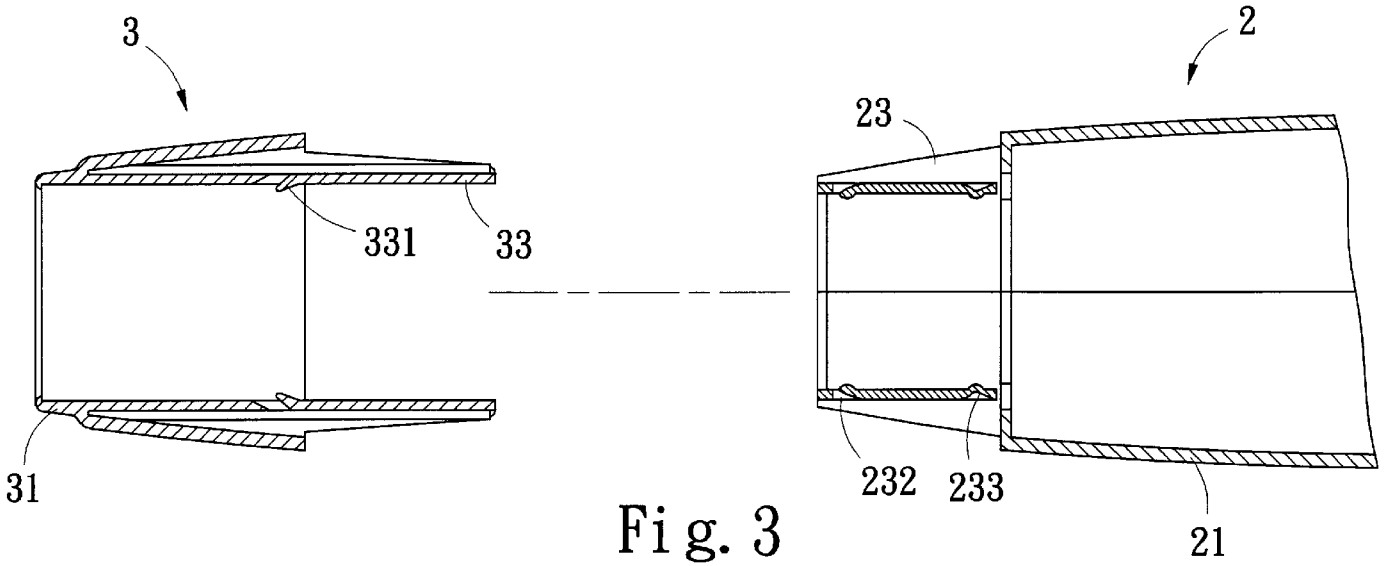
FIG. 3 is a sectional view of the heatproof sleeve and the housing of the present invention.
Figure 4:
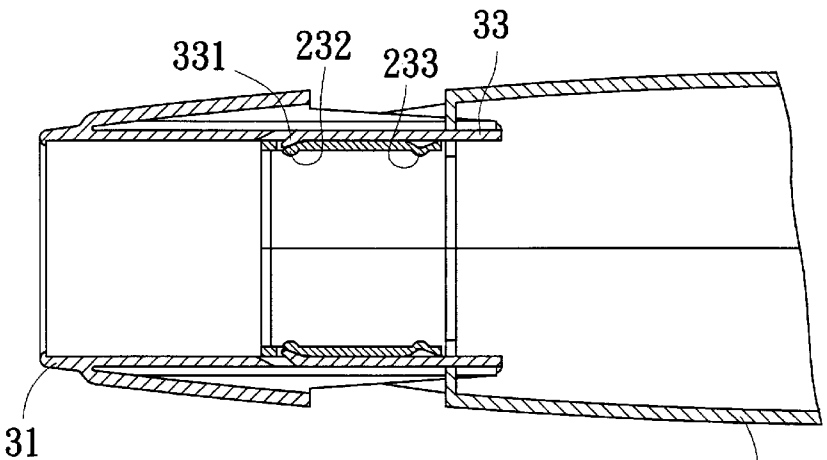
FIG. 4 is a sectional view showing the heatproof sleeve is pulled out of the front end of the housing of the heat gun of the present invention after it is extended into the two axial recesses on the front end.
Figure 5:
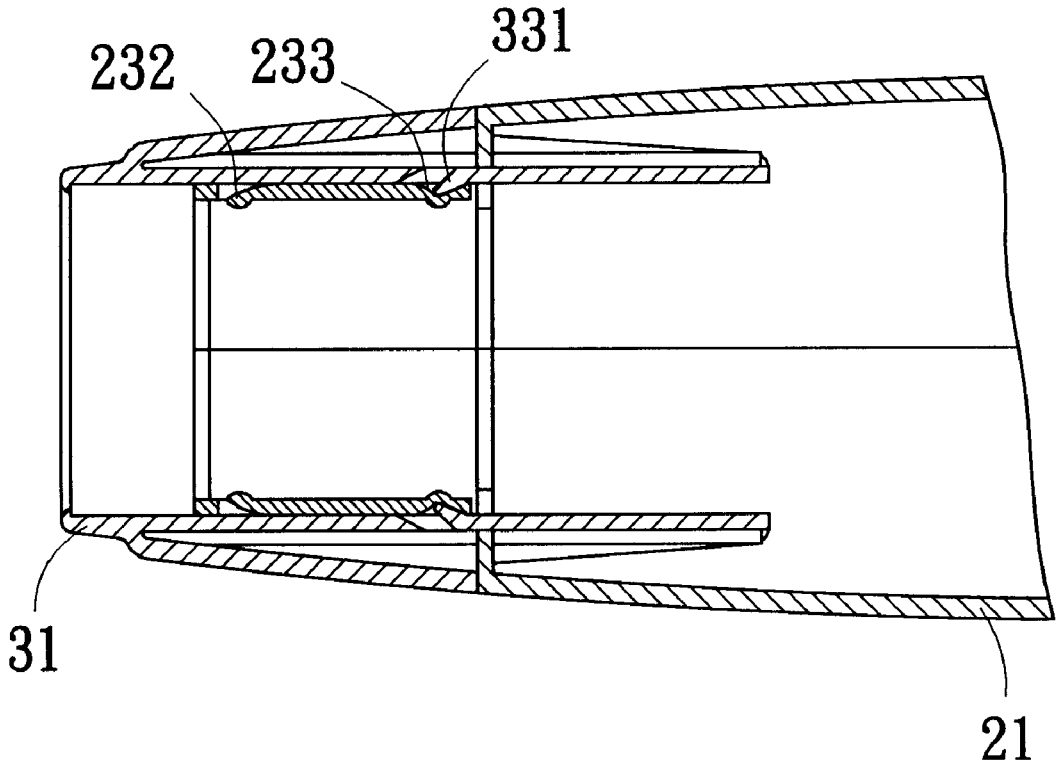
FIG. 5 is a sectional view showing the heatproof sleeve is retracted into the front end of the housing of the heat gun of the present invention after it is extended into the two axial recesses on the front end.
Figure 6:
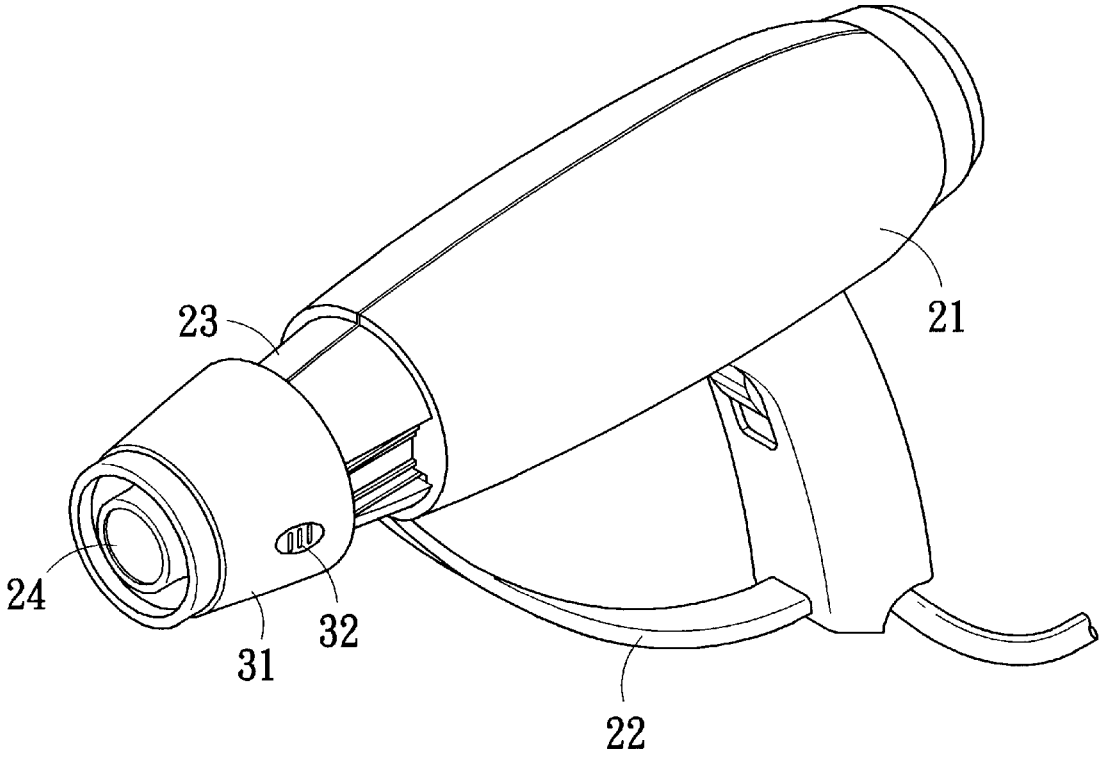
FIG. 6 is a perspective view showing the state of use when the heatproof sleeve is pulled out of the front end of the housing of the heat gun of the present invention.
Figure 7:
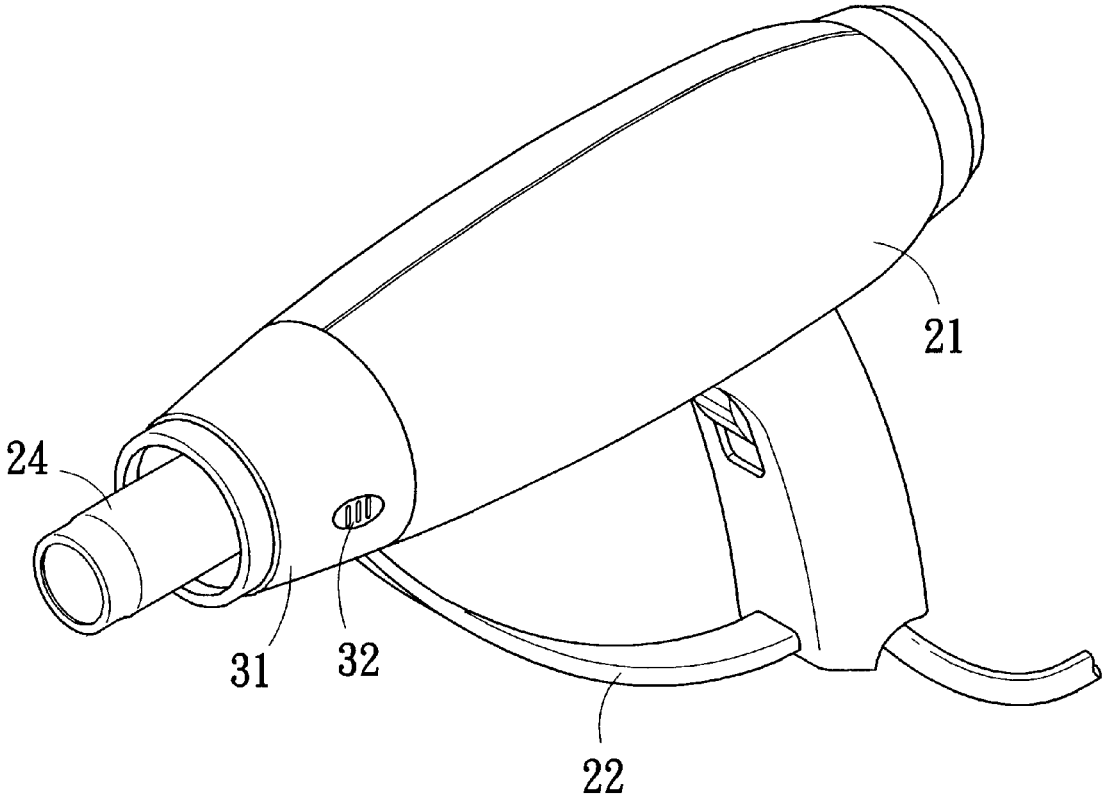
FIG. 7 is a perspective view showing the state of use when the heatproof sleeve is retracted into the front end of the housing of the heat gun of the present invention.

The heatproof sleeve 3 has a hollow housing 31 having a sliding-proof portion 32 provided on the surface thereof, the housing 31 has on each of the two lateral sides thereof a sheet 33 extending rearwardly. The sheet 33 is provided on the inner side thereof with a protrusion 331, so that when the heatproof sleeve 3 is slipped over the front end of the housing 2 of the heat gun (as shown in FIGS. 3–5), the two sheets 33 of the heatproof sleeve 3 extend into the two axial recesses 231 on the portion 23 with the reduced caliber, the engaging portions 232 can engage the protrusions 331, the heatproof sleeve 3 thereby can slide on the portion 23 with the reduced caliber on the front end of the housing 2 of the heat gun and will not drop. Additionally, the two axial recesses 231 are further provided each with a dent 233, so that the heatproof sleeve 3 can slide between the two engaging portions 232 and the two dents 233. When the heatproof sleeve 3 is pulled out, it will cover therein the inner pipe 24 (as shown in FIG. 6); and when it is retracted, the inner pipe 24 is exposed outside of the housing 2 of the heat gun (as shown in FIG. 7).

In operation, it can be decided according to an environment of construction whether the heatproof sleeve 3 shall be pulled out of the muzzle. For example, for a narrow environment of construction with a shorter time of using the heat gun, the heatproof sleeve 3 can be pulled out in the first place in favor of avoiding the user inadvertently scalding someone neighboring by his overly large action during operation;

while for a situation needing using the heat gun for a longer time, the temperature in the inner pipe 24 is very high, the heatproof sleeve 3 is not pulled out ordinarily in operation, rather, it is pulled out only when it has been used and cooled down in order not to scald someone. The present invention thereby has the following advantages:

1. The extendible/retractable heatproof sleeve can be used in completely different fields, times of construction and for different products on a heat gun, it can have both the function of as a heat gun and the safety of construction.
2. In storing the heat gun, the heatproof sleeve can be pulled out, this not only can avoid the heat gun scalding someone after use, but also can protect the inner pipe in the heat gun to prevent it from exposing that may make the inner pipe damaged or deformed by collision or dropping.
3. The present invention has a holding portion connected between the bottom of the shank and the bottom of the handle both of the heat gun for convenience of holding by a user, the heat gun can be hung on a high spot after use, it is convenient for storing.

In conclusion, according to the above disclosed, the present invention surely can achieve its expected object to provide a heat gun with an extendible/retractable safe heatproof sleeve.

Having thus described the technical process of my invention having industrial value, what I claim as new and desire to be secured by Letters Patent of the United States are:

1. A heat gun with an extendible/retractable safe heatproof sleeve comprising of:

a housing composed of two hollow half-housings abutted and connected with each other, a muzzle of said heat gun has on a front end thereof a portion with a reduced caliber that has two lateral sides provided each with an axial recess which has at least an engaging portion; and a heatproof sleeve being a hollow housing adapted to slipping over said portion with said reduced caliber on said front end of said housing of said blower, said housing has on each of two lateral sides thereof a sheet extending rearwardly, when said heatproof sleeve is slipped over said front end of said housing of said heat gun, said sheets extend into said two axial recesses on said portion with said reduced caliber, said heatproof sleeve thereby slides on said portion with said reduced caliber, said sheets each is provided on an inner side thereof with a protrusion, said engaging portions of said axial recesses thereby are adapted for engaging said protrusions, and said heatproof sleeve sliding on said front end of said housing of said heat gun does not drop.

2. A heat gun with an extendible/retractable safe heatproof sleeve as in claim 1, wherein said two axial recesses are further provided each with a dent, so that said heatproof sleeve slides between said engaging portions and said two dents.

3. A heat gun with an extendible/retractable safe heatproof sleeve as in claim 1, wherein a holding portion is connected between the bottom of a shank and the bottom of a handle both of said heat gun for convenience of holding by a user.

4. A heat gun with an extendible/retractable safe heatproof sleeve as in claim 1, wherein said heatproof sleeve is provided with a sliding-proof portion.

* * * * *